US005624273A

United States Patent [19]

Myer

[11] Patent Number: 5,624,273

[45] Date of Patent: Apr. 29, 1997

[54] INSULATION DISPLACEMENT CONTACT WITH STRAIN RELIEF

[75] Inventor: John M. Myer, Millersville, Pa.

[73] Assignee: The Whitaker Corporation, Wilmington, Del.

[21] Appl. No.: 426,308

[22] Filed: Apr. 21, 1995

[51] Int. Cl.[6] ..... H01R 4/26

[52] U.S. Cl. ..... 439/399; 439/407; 439/409; 439/748; 439/752.5; 439/852

[58] Field of Search ..... 439/397, 399, 439/400

[56] References Cited

U.S. PATENT DOCUMENTS

| | | | |
|---|---|---|---|
| 3,366,343 | 1/1968 | Slater et al. | 174/65 R |
| 3,713,080 | 1/1973 | Kennedy | 339/258 R |
| 3,860,316 | 1/1975 | Hardesty | 339/91 R |
| 3,998,514 | 12/1976 | Hardesty | 339/99 R |
| 4,097,106 | 6/1978 | Over et al. | 339/99 R |
| 4,195,898 | 4/1980 | Chow et al. | 339/99 R |
| 4,385,794 | 5/1983 | Lucius | 439/399 |
| 4,424,406 | 1/1984 | Slater et al. | 174/65 R |
| 4,493,523 | 1/1985 | Leong et al. | 339/105 |
| 4,550,963 | 11/1985 | Moors | 339/31 R |
| 4,705,482 | 11/1987 | Endo et al. | 439/460 |
| 4,749,370 | 6/1988 | Moser et al. | 439/460 |
| 4,846,720 | 7/1989 | Song | 439/407 |
| 4,940,425 | 7/1990 | Hass et al. | 439/397 |
| 5,030,136 | 7/1991 | Reinhardt et al. | 439/460 |
| 5,083,938 | 1/1992 | Poliak | 439/460 |
| 5,277,617 | 1/1994 | Shasteen | 439/465 |
| 5,368,494 | 11/1994 | Lai | 439/188 |
| 5,427,544 | 6/1995 | Okabe | 439/397 |

FOREIGN PATENT DOCUMENTS

| | | | |
|---|---|---|---|
| 0279508 | 8/1988 | European Pat. Off. | 439/397 |

*Primary Examiner*—Neil Abrams
*Assistant Examiner*—Eugene G. Byrd

[57] ABSTRACT

An electrical contact assembly (80) includes an electrical contact (10) with a contact section (20), IDC section (30) and a relief section (40). The electrical contact (10) is disposed in a dielectric housing (60) having a rotatable stuffer member (70) for pushing a wire (12) into electrical engagement with IDC section (30). Force vector F is a separating force which will cause the strain relief section (40) to deflect and thereby more firmly grip the wire (12) between a retention gripping portion (46) and a retention surface (76) of stuffer (70). Any separating force will cause stop member (27) of contact section (20) to engage a shoulder (62) of housing (60) thereby causing a shearing action as an edge (**28*b*) engages the stop member (27**).

34 Claims, 4 Drawing Sheets

INSULATION DISPLACEMENT CONTACT WITH STRAIN RELIEF

The present invention relates to an electrical connector comprising a dielectric housing and an insulation displacement (IDC) contact with a wire strain relief section on the contact. More particularly, the present invention relates to the strain relief section of the IDC contact whereby tensile forces acting on the wire terminated in the IDC contact are converted to use in increasing the frictional retention forces which tend to resist the tensile forces.

BACKGROUND OF THE INVENTION

A prior electrical connector employing strain relief in combination with an IDC terminal is disclosed in U.S. Pat. No. 4,097,106. This known invention relates to a housing of insulating material adapted to accommodate an electrical terminal, and includes a strain relief member adapted to be crimped into engagement around the wire terminated to the terminal. More particularly, the strain relief member consists of a pair of vertical walls formed on the housing which are crimped inwardly and downwardly for mechanically gripping the outer insulation jacket of the wire. This known invention has the advantage of being able to terminate a wire to an IDC contact while at the same time providing strain relief; however, in order for the electrical connector to perform its strain relief function, the vertical housing walls must be crimped inwardly to engage the wire insulation.

A second electrical connector employing strain relief is shown in U.S. Pat. No. 4,705,482. This reference discloses a bent electrical contact which engages a bare conductor on the wire to be terminated. The electrical contact imparts a spring pressure to the conductor thereby holding the conductor in place within the housing. However, this invention has a disadvantage in that when the connector is reduced in size, the connector terminal is also reduced in size, thereby decreasing the spring force exerted by the terminal on the wire conductor and necessarily reducing the frictional retention forces generated by the contact spring force. This mitigates against reduced terminal connector applications for the connector since inadvertent disconnection of the conductor from the connector terminal can occur.

Another electrical connector including strain relief is shown in U.S. Pat. No. 4,493,523. The electrical device disclosed therein has an entry hole through which a wire may be passed. This electrical device has a serrated corner positioned opposite to the entry hole, and a flexible finger near the entry hole. A wire inserted in the entry hole is locked between the finger and the serrated corner. This known device also provides a means to make electrical interconnections while at the same time providing strain relief to the terminated wire; however, the strain relief finger is molded monolithically with the housing, the finger requires a high degree of material in order to have sufficient retaining characteristics, and requires a void space for its flexure motion.

SUMMARY OF THE INVENTION

The present invention provides electrical connector assembly for terminating at least one electrical wire, and includes: a dielectric housing with a recess for receiving an electrical contact therein; an electrical connector disposed in said recess comprising an integral contact section having a stop member for engaging said housing, an integral contact termination section for termination with said wire, and an integral strain relief section for engaging said wire and preventing the transmission of a tensile force acting on said wire to said strain relief section; and a stuffer member adapted to be pressed into engagement with said housing, and for pressing said wire into electrical engagement with said contact termination section.

The present invention overcomes the deficiencies of the prior art by providing an IDC contact which: does not necessarily require the additional method step of crimping a wire in order to provide the strain relief effect; will securely mechanically hold the wire to be terminated to the electrical connector; eliminates the need for extra parts by forming the strain relief member integrally with the IDC contact; and is of low cost, is easy to manufacture, and uses space economically. Moreover, the present invention advantageously provides a strain relief section for the IDC contact whereby tensile forces, which tend to separate a wire from its respective contact, are converted to use in increasing the frictional retention forces, which retention forces tend to resist the tensile forces. This conversion is accomplished by action of the strain relief section, which rotatably and frictionally engages the wire in an effectively neutralizing response to such tensile forces so that the wire is proportionately more firmly grasped between the strain relief section and the connector housing. The frictional retention forces are directly proportional to the tensile (separating) forces: the greater the separating force, the greater will be the retention forces opposing them. Additionally, the present invention provides advantageous features for its retention in an electrical connector housing, and is adaptable for the termination of large or small gauge wires singly or in mass termination applications.

DETAILED DESCRIPTION OF THE INVENTION

Figure 1:
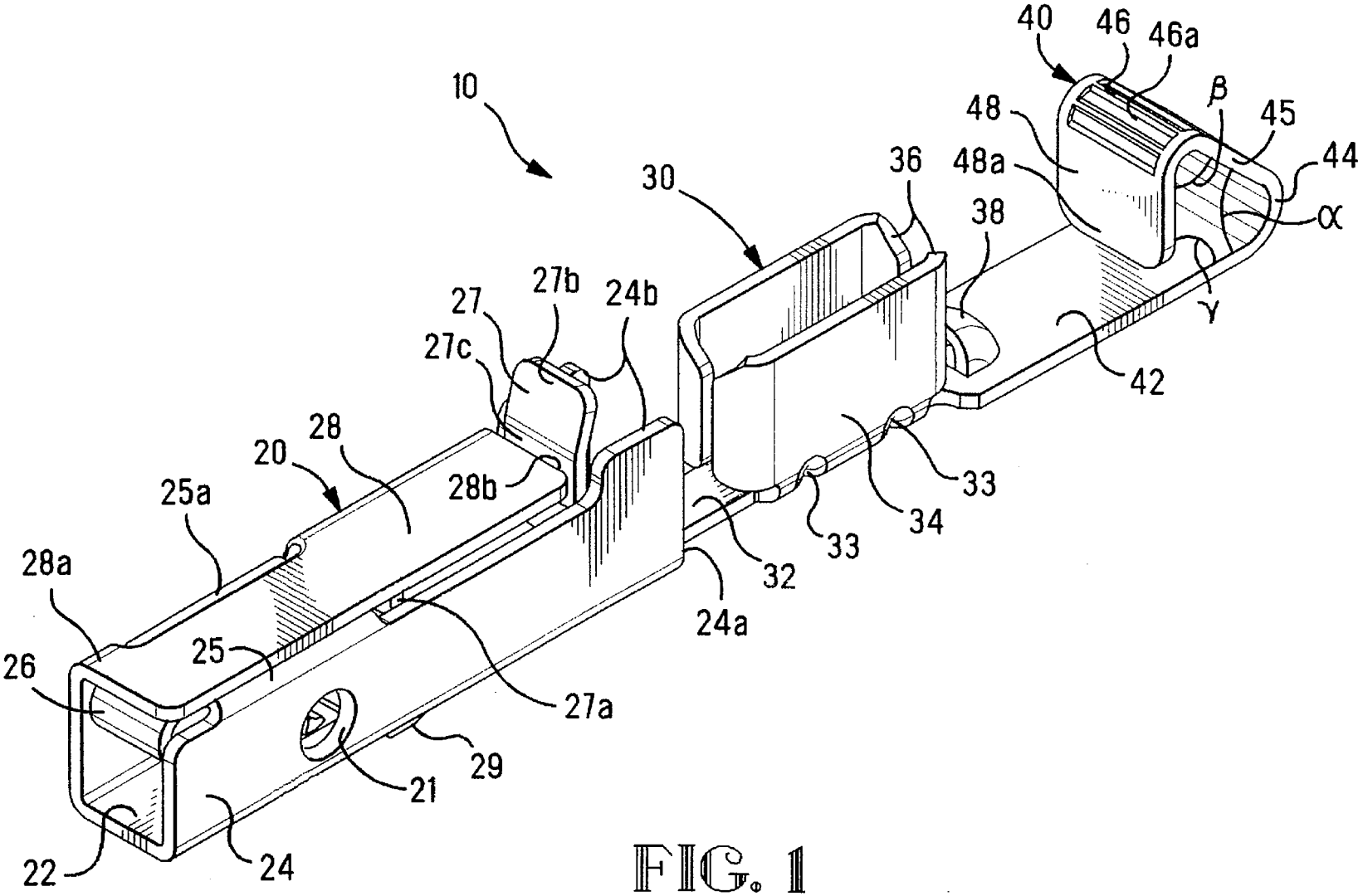
FIG. 1 shows an isometric view of the electrical contact according to the present invention.

FIG. 1 shows an electrical contact 10 having a contact section 20, an IDC section 30, and a strain relief section 40. Contact section 20 includes: a base portion 22 with overstress 22*a*; walls 24 having edges 24*a* and shoulders 24*b* with one wall 24 having a hole 21 formed therein; an inner top portion 25 with a locking tab 25*a*; a resilient leg 26 for engaging a further electrical component (e.g. a tab or pin contact); a resiliently deflectable stop member 27 with bends 27*a*, a stop leg 27*b*, and a plate 27*c*; an edge 28*b* and an outer top portion 28 having a tab aperture 28*a* for receiving locking tab 25*a*; and a resilient off-set portion 29 formed on the bottom of contact section 20 for connection to an electrical connector housing. Offset portion 29 is formed adjacent to a platform 29*a*, which platform advantageously helps to control the contact forces generated between leg 26 and platform 29*a* when a tab or pin has been inserted into electrical contact 10.

Still referring to FIG. 1, IDC section 30 (IDC) includes a base portion 32 with upstanding walls 34 formed thereon, which walls include IDC blades 36 for receiving, stripping the insulation from a prtion of, and terminating an electrical conductor. Stiffening gussets 33 are formed between base section 32 and walls 34 for increasing the contact force generated by the walls 34. Additionally, IDC section 30 includes a boot 38 for uplifting and supporting the wire to be terminated to a more centralized and contact force maintaining location between blades 36.

Strain relief section 40 includes a base portion 42 with a bend 44 extending therefrom. Bend 44 is connected to an intermediate portion 45, and intermediate portion 45 is connected to a generally arcuate wire gripping portion 46. The radius of bend 44 is advantageously greater than the radius of bend 46 for flexibility of intermediate portion 45 and portion 46 about bend 44, but it is contemplated that other radii may be used. Wire gripping portion 46 includes serrations 46*a* for engaging a wire, as will be described below. Strain relief section 40 further includes an overstress leg 48 having an edge 48*a* for engagement with base portion 42 when and if edge 48*a* is deflected that far. Strain relief section 40 comprises three angles: angle $\alpha$, defined by base portion 42 and intermediate portion 45; angle $\beta$, defined by intermediate portion 45 and overstress leg 48; and angle $\gamma$, defined by base portion 42 and overstress leg 48.

Figure 2:
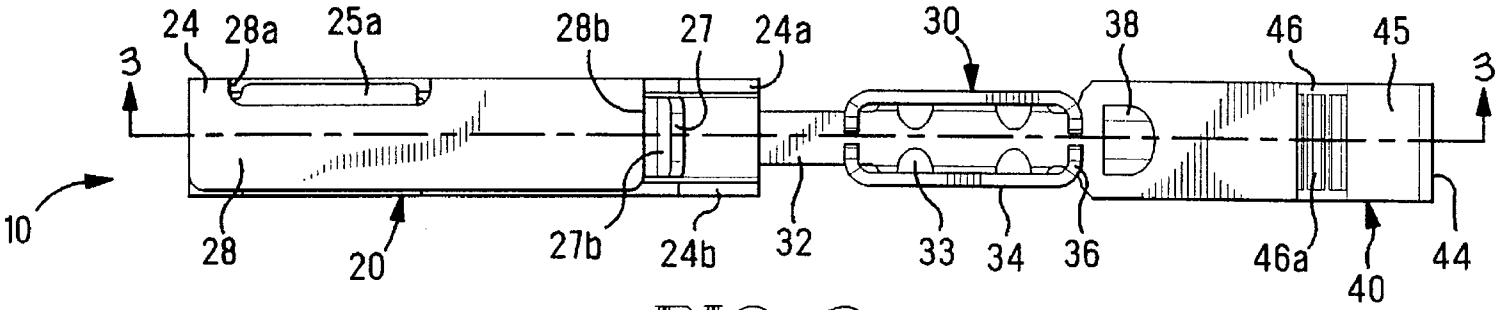
FIG. 2 shows a top view of the electrical contact of FIG. 1.

Now referring to FIG. 2, a top view of the electrical contact 10 of FIG. 1 is shown. This view shows locking tab 25*a* of inner top portion 25 protruding through tab aperture 28*a* of outer top portion 28 thereby effectively interlocking inner top portion 25 to outer top portion 28. Additionally, boot 38 is shown laterally aligned with blades 36 of IDC section 30 for uplifting a wire to be terminated in the IDC section 30.

Figure 3:
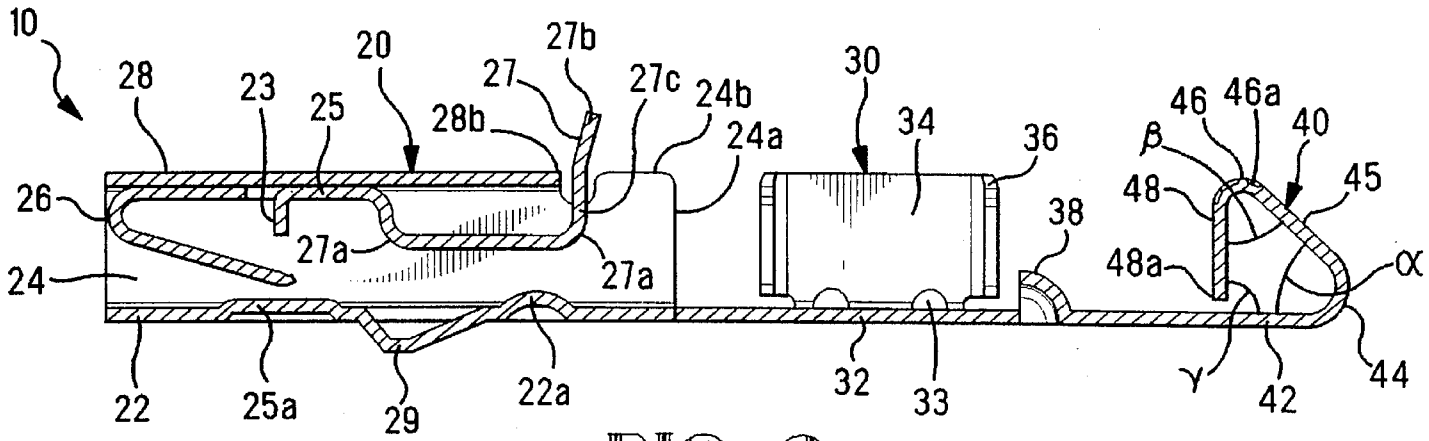
FIG. 3 shows a side cross sectional view of the electrical contact of FIG. 2 taken along line 3—3.

Referring to FIG. 3, a cross sectional view of the electrical contact of FIG. 1 taken along line 3—3 of FIG. 2 is shown. FIG. 3 provides a good view of overstress stop 23 of contact section 20, which stop is aligned for engagement with resilient leg 26 when a tab or pin contact is inserted into the contact section 20. Stop 23 will, if necessary, engage the end of resilient leg 26 thereby preventing overstress of the resilient leg 26. FIG. 3 also shows: bends 27*a* of stop member 27; plate 27*c* aligned for engagement with edge 28*b* of outer top portion 28, as will be further described below; offset portion 29 which is formed into base portion 22; edges 24*a* of wall 24; overstress 22*a* for preventing overstress of stop member 27; and angles $\alpha$, $\beta$, and $\gamma$.

Figure 4:
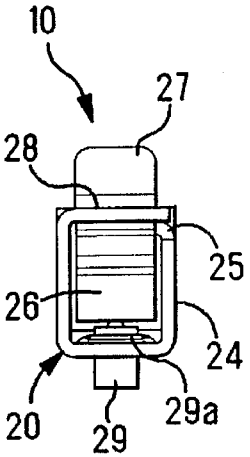
FIG. 4 shows a front elevational view of the electrical contact of FIG. 1.

Referring to FIG. 4, a front elevational view of the contact 10 is shown depicting the various parts of contact section 20.

Figure 5:
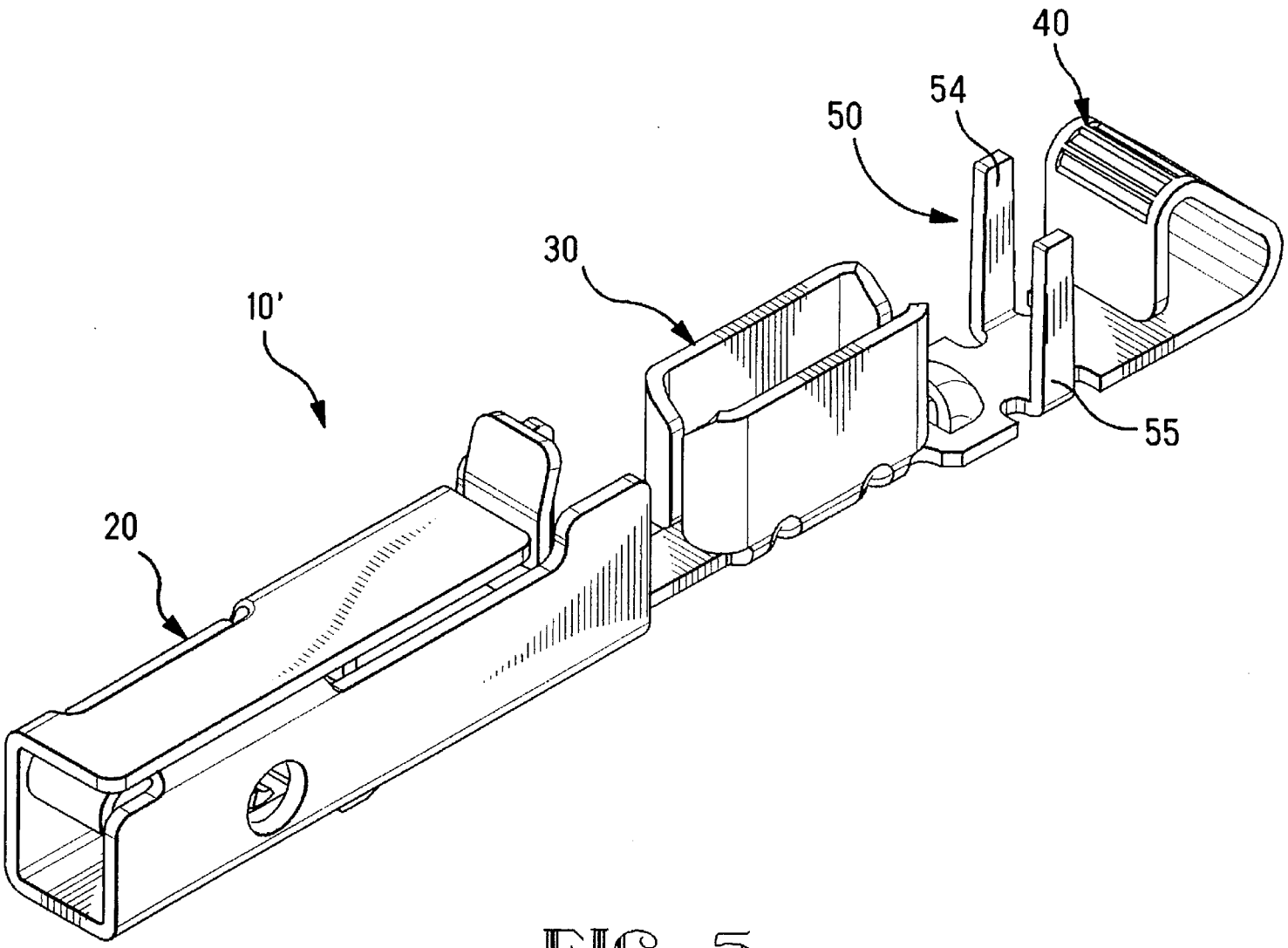
FIG. 5 shows an isometric view of a second embodiment of the present invention.

FIG. 5 shows a second embodiment 10' of the present invention. Electrical contact 10' includes a contact section 20, an IDC section 30, and a strain relief section 40, which sections are similar or identical to that of electrical contact 10 as described above. However, electrical contact 10' includes a "wrap around" strain relief member 50 comprising gripping tabs 54 and 55. Tabs 54 and 55 are crimpable tabs adapted for crimpable engagement with the insulation of a wire to be terminated in the electrical contact 10'.

Figure 6:
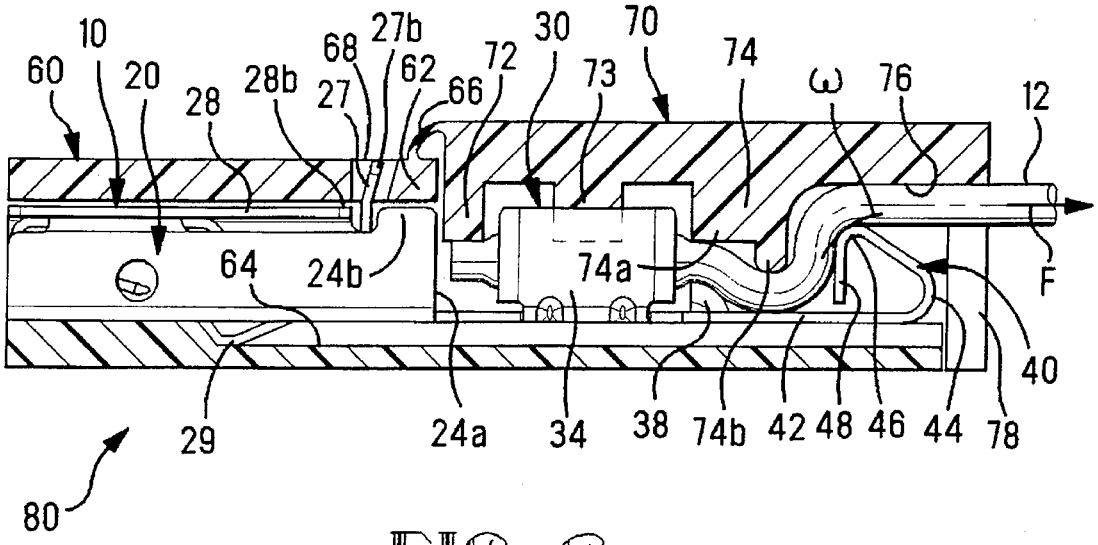
FIG. 6 shows a cross sectional view of an electrical connector assembly according to the present invention.

Now referring to FIG. 6, an electrical connector assembly 80 is shown which includes a housing 60, a stuffer 70, and the electrical contact 10 having a wire terminated therein disposed within the housing 60 and stuffer 70. Housing 60 includes a recess for receiving contact 10 and a shoulder 62 disposed adjacent to stop member 27 of contact section 20 when the stop member is disposed within an aperture 68 of housing 60. A recess 64 is formed in a lower portion of housing 60 for accommodating offset portion 29 of contact section 20 when the contact 10 is disposed within the housing 60. As the contact 10 is slid into housing 60 stop member 27 will engage shoulder 62 and will thereby be deflected downwardly until it passes shoulder 62 at which point the stop member 27 will resile upwardly into aperture 68. Stuffer 70 is hingeably attached to housing 60 by hinge 66, but it is contemplated that stuffer 70 can be formed as wholly separate from housing 60. Stuffer 70 includes a front ram 72, a middle ram 73, a rear ram 74 with edge 74*a* and nose 74*b*, a frictional retention surface 76, and a wire guide 78.

Referring to the embodiment of FIG. 6, assembly of the electrical contact assembly 10 is accomplished by inserting electrical contact 10 into housing 60 so that offset portion 29 of contact section 20 registers with recess 64, and stop leg 27 is located adjacent to shoulder 62. A wire 12 is then placed over the IDC walls 34 in axial alignment with blades 36 of IDC section 30. At this time, cover 70 is rotated about hinge 66, and rams 72–74 pressingly engage wire 12, thereby stuffing wire 12 into electrical engagement with IDC section 30 between walls 34 and blades 36 thereof. It is important to note, however, that front ram 72 engages a front surface of wire 12, middle ram 73 engages a portion of the wire 12 within IDC section 30, and edge 74*a* of rear ram 74 engages an axially opposing surface of wire 12. Moreover, nose 74*b*, which downwardly protrudes from rear ram 74, pushes a respective portion of wire 12 into engagement base portion 42. Boot 38 maintains a centerline of wire 12 relatively higher than a centerline of the respective portion of wire 12 adjacent to nose 74*b*. It is also important to note that wire 12 is poised for frictional engagement with serrations 46*a* of wire gripping portion 46 and overstress leg 48 of strain relief section 40, and is arranged for frictional engagement with retention surface 76 of stuffer 70. Thus, wire 12 comprises a series of contortious bends, and thereby is conformed to a torturous path within assembly 80.

As shown in the right hand side of FIG. 6 a tensile force vector F, when it is applied to wire 12, will cause strain relief section 40 to deflect, resulting in an increase in angle $\alpha$ (see FIG. 3), and thereby defining an eccentric arc $\omega$ as shown in the drawing. As wire gripping portion 46 of strain relief section 40 is moved along this eccentric arc, the effective distance between wire gripping portion 46 and retention section surface 76 will decrease. The decrease in distance will result in a squeezing effect, i.e. a greater magnitude in gripping force will be applied to the wire 12 by retention surface 76 of stuffer 70 and wire gripping portion 46. Thus the tensile force F acting on the wire terminated in the IDC is converted to use in increasing the frictional retention forces which tend to resist the tensile forces, thereby creating a "Chinese finger" effect, and which conversion prevents the transmission of tensile forces to the contact termination section 30.

The tensile force transmitted to wire 12 by force vector F will cause a force to be applied generally to contact 10. However, bend 44 of strain relief section 40 will not abut the housing 60 but, rather, the force transmitted to electrical contact 10 will be borne by edges 24*a* and shoulders 24*b* of walls 24 of contact section 20, which edges and shoulders engage a portion of front ram 72 of stuffer 70, and bend 44 may bear against wire guide 78. As wire 12 is more firmly gripped between wire gripping portion 46 and retention surface 76, no forces will be transmitted to the IDC section 30, thereby advantageously preserving the electrical continuity between walls 34 of IDC section 30 and the conductive core inside wire 12.

Moreover, any force vector F which tends to separate the contact 10 from housing 60 will result in a shearing force being applied to stop member 27. Force vector F will tend to shift electrical contact 10 relatively to the right as shown in FIG. 6 (with the housing 60 remaining stationery). Stop leg **27*b* of stop member 27 will thus engage shoulder 62 of housing 60. As this occurs, stop member 27 will be resiliently deflected towards and will forcibly engage edge 28*b* of outer top portion 28 of contact section 20. Thus a shearing force is imparted to stop member 27 by engagement of edge 28*b* with stop member 27 on a lower side, and the shoulder 62 of housing 60 engaging stop member 27 on an upper side. Since this shearing force is resisted by generally the full thickness of stop member 27, electrical contact 10 is capable of withstanding a great deal of force tending to separate it from housing 60**.

Figure 7:
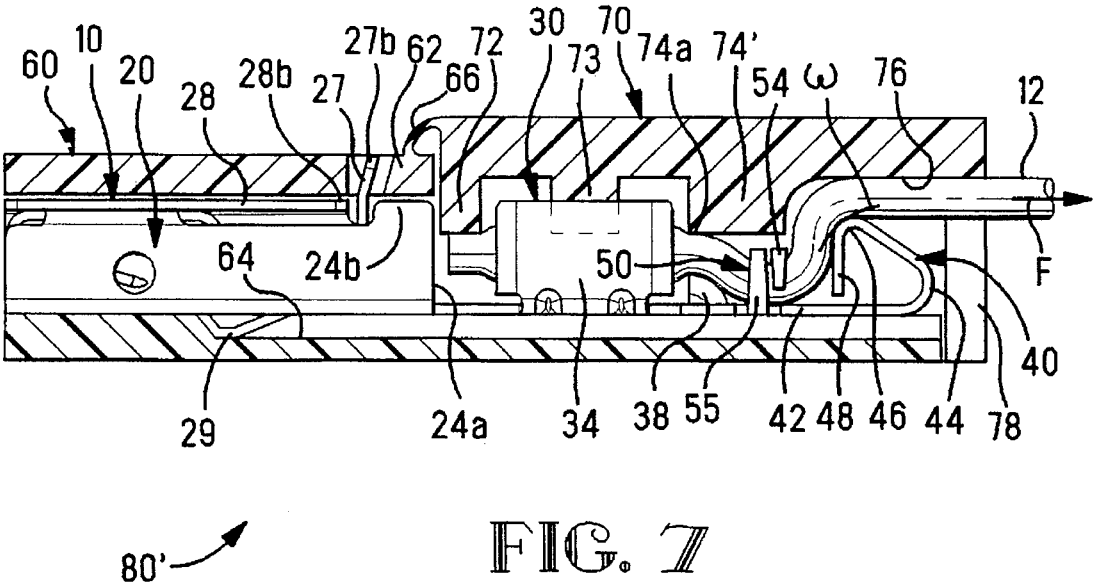
FIG. 7 shows a cross sectional view of a second embodiment of an electrical connector assembly according to the present invention.

Referring now to FIG. 7, electrical connector assembly 80' will be described. Assembly 80' essentially incorporates electrical contact 10' into housing 60 with a stuffer 70 similar to the embodiment of FIG. 6. However, the rear ram 74 has been modified to a rear ram 74' with a truncated lower surface. Truncating the lower surface of rear ram 74' creates space for wrap around strain relief member 50 with gripping tabs 54 and 55 for firmly capturing the wire 12 thereby obviating the need for a further gripping portion such as, for example, the nose **74*b* of rear ram 74 of the embodiment of FIG. 6**.

Thus, while preferred embodiments of the invention have been disclosed, it is to be understood that the invention is not to be strictly limited to such embodiments but may be otherwise variously embodied and practiced within the scope of the appended claims. For example, although stuffer 70 is shown hinged to housing 60 by a hinge 66, it is contemplated that stuffer 70 can be a wholly separate member. Moreover, although receptacle contacts 10 and 10' have been disclosed, it is contemplated that the present invention can be adapted for use with any IDC contact including pin, tab, or other interconnection systems. Additionally, it is contemplated that boot 38 can take the form of a mere tab. It is also contemplated that the housing 60 and stuffer 70 can be modified to include a plurality of electrical contacts 10 and/or 10' for mass termination of a plurality of wires 12. It is also contemplated that the stuffer 70 can be modified to eliminate the middle ram 73 and still satisfactorily perform its wire stuffing function.

The ideal engineering materials for the electrical contacts disclosed above will comprise metals having high strength, high conductivity, and a low cost. For example, such metals as copper, brass, bronze, beryllium copper, copper alloys, steel, nickel, aluminum; and zinc. Additionally, it is preferred that the above described contacts comprise a stamped and formed contact. However, other methods may be used to form the contact as well. It is further desired that the electrical contacts will be coated or plated for corrosion resistance. For example, a coating comprising tin, tin low lead, tin lead, nickel, gold, silver, copper, zinc, or palladium. It is further contemplated that the electrical contacts will be plated by, for example, an electro-deposition process. The housing 60 and stuffer 70 can be formed of any suitable dielectric plastic or other dielectric material.

I claim:

1. An electrical contact for termination with an electrical wire and for insertion into a connector housing, comprising:

an integral contact section;

an integral contact termination section for termination with said wire; and an integral strain relief section for engaging said wire and preventing the transmission of tensile forces acting on said wire to said contact section, said strain relief section comprises first and second bends formed in said electrical contact, and said second bend comprises a surface for engaging said wire.

2. The electrical contact of claim 1, wherein said contact termination section includes a pair of insulation displacement blades.

3. The electrical contact of claim 2, wherein a boot is formed on said contact termination section for guiding said wire to a position between said blades.

4. The electrical contact of claim 1, wherein said second bend comprises a serrated surface for frictional engagement with said wire.

5. The electrical contact of claim 1, wherein said first bend comprises a radius which is larger than a radius of said second bend.

6. The electrical contact of claim 1, wherein said first bend comprises a flexible bend for flexing in response to said tensile force acting on said wire.

7. The electrical contact of claim 1, wherein said strain relief section comprises an overstress leg connected to said second bend.

8. The electrical contact of claim 1, wherein said first bend comprises an angle which directs said second bend location relatively toward said contact termination section.

9. The electrical contact of claim 1, wherein said contact termination section is located between said contact section and said strain relief section.

10. An electrical connector assembly for terminating at least one electrical wire, comprising:

a dielectric housing with a recess for receiving an electrical contact therein;

an electrical contact disposed in said recess comprising an integral contact section, an integral contact termination section for termination with said wire, and an integral strain relief section for engaging said wire and preventing the transmission of a tensile force acting on said wire to said contact section, said strain relief section comprises first and second bends formed in said electrical contact adjacent to said stuffer member, and said second bend and said stuffer member each comprise a surface for frictionally engaging said wire; and a stuffer member adapted to be pressed into engagement with said housing, and said stuffer member is adapted for pressing said wire into electrical engagement with said contact termination section.

11. The electrical connector assembly of claim 10, wherein said contact termination section includes a pair of insulation displacement blades.

12. The electrical connector assembly of claim 11, wherein a boot is formed on said contact termination section for guiding said wire to a position between said blades.

13. The electrical connector assembly of claim 10, wherein said second bend comprises a serrated surface for frictional engagement with said wire.

14. The electrical connector assembly of claim 10, wherein said first bend comprises a radius which is larger than a radius of said second bend.

15. The electrical connector assembly of claim 10, wherein said first bend comprises a flexible bend for flexing in response to said tensile force.

16. The electrical connector assembly of claim 10, wherein said strain relief section comprises an overstress leg connected to said second bend.

17. The electrical connector assembly of claim 10, wherein said stuffer member comprises a front ram and a rear ram, said rams are adapted to engage and displace said wire.

18. The electrical connector assembly of claim 17, wherein said contact termination section is located between said rams.

19. The electrical connector assembly of claim 17, wherein said contact termination section comprises insulation displacement blades and is located between said rams.

20. The electrical connector assembly of claim 10, wherein said stuffer member comprises a front ram, and said electrical contact comprises crimpable tabs for crimping an insulation of said wire.

21. The electrical connector assembly of claim 20, wherein said contact termination section is located between said ram and said crimpable tabs.

22. The electrical connector assembly of claim 20, wherein said contact termination section comprises insulation displacement blades and is located between said ram and said crimpable tabs.

23. The electrical connector assembly of claim 10, wherein said stuffer member comprises a front ram, a middle ram and a rear ram, and said rams are adapted to engage and displace said wire.

24. An electrical contact having a termination section for contact with a further electrical contact, and an IDC termination section for electrical termination with a conductor, said contact comprises:

an integral strain relief section for strain relieving engagement with the conductor, the strain relief section includes a wire interface section and a flexible section, whereby the wire interface section is rotatable about the flexible section for strain relieving engagement with the conductor.

25. The contact of claim 24, wherein the strain relief section includes an overstress section for delimiting movement of the wire interface section.

26. The contact of claim 24, wherein said strain relief section comprises a stamped metal extension of said contact.

27. The contact of claim 24, wherein when said contact is mounted in an electrical connector housing the wire interface section of the strain relief section and a section of the housing cooperate in providing strain relief to the conductor.

28. The contact of claim 24, wherein the termination section includes a deflectable stop member for retaining the contact in an electrical connector housing.

29. The contact of claim 28, wherein the stop member extends generally transversely of an edge of the termination section, and generally transversely of a shoulder of the housing, whereby said edge and said shoulder are generally aligned to apply shear forces to said stop member in retaining the contact in the housing.

30. The contact of claim 24, wherein said contact is disposed in a housing, and said housing includes ram members for aligning the conductor in the contact.

31. The contact of claim 30, wherein the ram members are formed on a stuffer hinged to the housing.

32. The contact of claim 31, wherein the stuffer includes a wire engaging surface for cooperating with the strain relief section in trapping said conductor therebetween, for strain relieving the conductor.

33. An electrical connector assembly for terminating at least one electrical wire, comprising:

a dielectric housing with a recess for receiving an electrical contact therein;

an electrical contact disposed in said recess comprising an integral contact section having a stop member for engaging said housing, an integral contact termination section for termination with said wire, and an integral strain relief section for engaging said wire and preventing the transmission of a tensile force acting on said wire to said contact section;

a stuffer member adapted to be pressed into engagement with said housing, and is adapted for pressing said wire into electrical engagement with said contact termination section; and a first portion of said strain relief section is deflectable, and a second portion of said strain relief section deflects in response to said tensile force, thereby reducing a distance defined between a wire engaging surface of said stuffer member and a surface of said second portion for squeezing said wire therebetween.

34. The electrical connector assembly of claim 33, wherein said second portion moves in an arc in response to said deflection.

* * * * *